US006962474B2

(12) United States Patent
Neunteufel et al.

(10) Patent No.: US 6,962,474 B2
(45) Date of Patent: Nov. 8, 2005

(54) LOADER

(75) Inventors: Hans Neunteufel, Linz (AT); Josef Erlinger, Herzogsdorf (AT)

(73) Assignee: NEUSON Baumaschinen GmbH, Leonding (AT)

( * ) Notice: Subject to any disclaimer, the term of this patent is extended or adjusted under 35 U.S.C. 154(b) by 195 days.

(21) Appl. No.: 10/430,066

(22) Filed: May 6, 2003

(65) Prior Publication Data

US 2004/0223837 A1 Nov. 11, 2004

(51) Int. Cl.[7] ..... B66C 23/00
(52) U.S. Cl. ..... 414/685; 414/680
(58) Field of Search ..... 414/680, 685, 414/686, 722; 280/164.1

(56) References Cited

U.S. PATENT DOCUMENTS 2,485,334 A * 10/1949 Terry ..... 414/680
2,610,752 A * 9/1952 Luebbers ..... 414/686
6,149,374 A 11/2000 Dershem et al.

FOREIGN PATENT DOCUMENTS

DE 1 015 386 2/1957
GB 743186 10/1952

* cited by examiner

*Primary Examiner*—Donald W. Underwood
(74) *Attorney, Agent, or Firm*—Collard & Roe, P.C.

(57) ABSTRACT

A loader is described, having a support frame (1) supported on front and rear wheels (2, 3) and receiving a driver cabin (4), to which a front boom (5) is linked on the rear side of the driver cabin (4), having two spars (6) running on both sides of the driver cabin (4), which form a curved section (10) overlapping the particular front wheel (2), and having a pivot drive (7) engaging on the lateral spars (6) for raising and lowering the front boom (5). In order to provide advantageous construction ratios, it is suggested that the spars (6) have a lengthwise section (9), engaging between the front and rear wheels (2, 3) in the lowered setting of the front boom (5) and running below a lateral cabin entrance, to which the curved section (10) overlapping the particular front wheel (2) is attached.

3 Claims, 1 Drawing Sheet

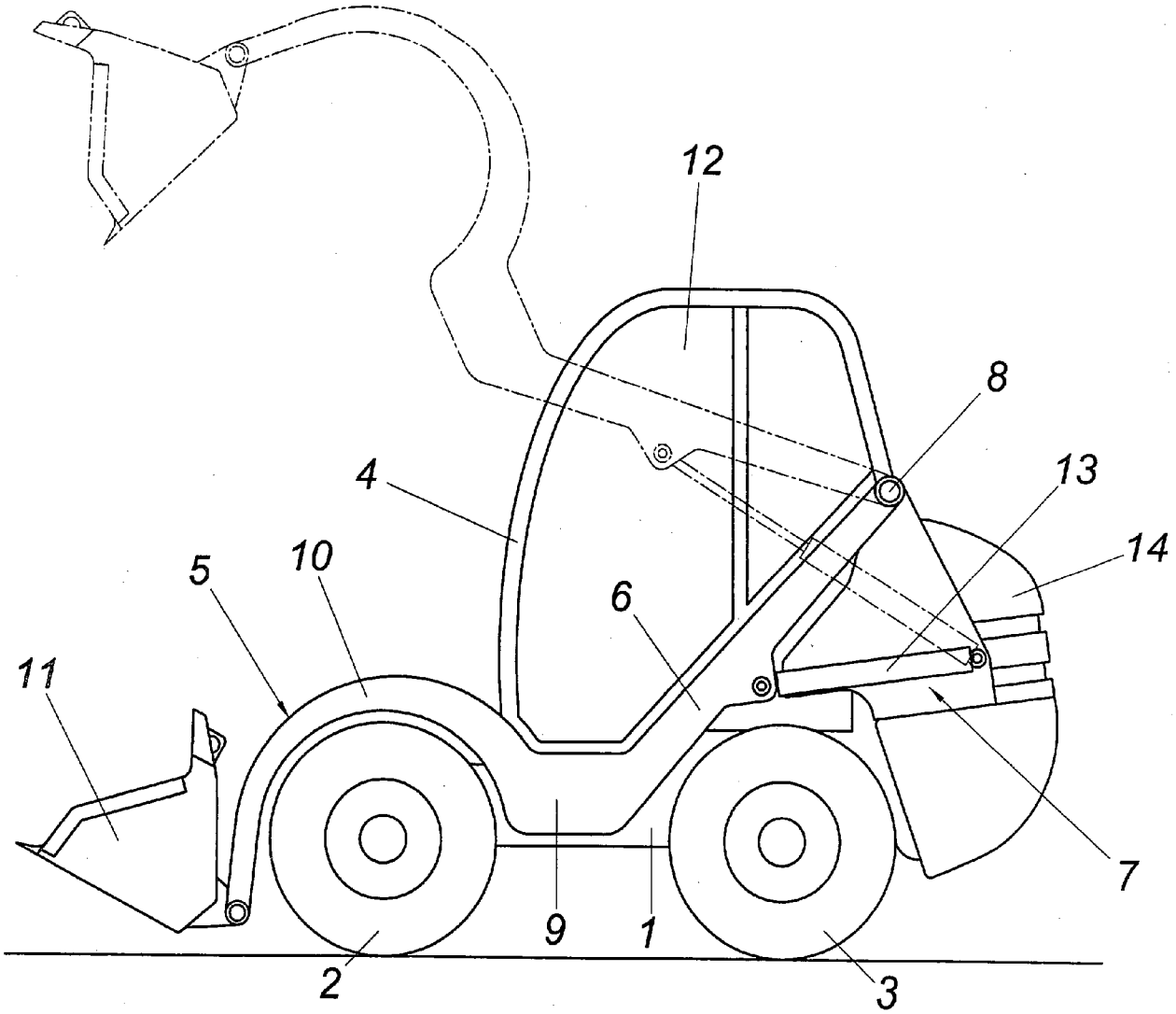
14
13
8
12
4
10
5
11
7
6
3
1
9
2

LOADER

FIELD OF THE INVENTION

The present invention relates to a loader having a support frame, supported on front and rear wheels, which receives a driver cabin, on which a front boom having two spars running on both sides of the driver cabin, which form a curved section overlapping the particular front wheel, is linked on the rear side of the driver cabin and having a pivot drive engaging on the lateral spars for raising and lowering the front boom.

DESCRIPTION OF THE PRIOR ART

For two-axle loaders having a front boom, which is linked on the rear side of the driver cabin on a support frame, advantageous lever ratios result for the raising and lowering of the tools and/or devices attachable to the front boom, because the linkage axis may be positioned relatively high, which produces a low offset of the tools and/or devices in the lengthwise direction of the loader as the front boom is raised and lowered, due to the greater length of the front boom, without having to restrict the stroke height, which is significant for small loaders in particular. In addition, the weight of a rear pivot drive for the front boom improves the tip resistance of the loader. However, such loaders (U.S. Pat. No. 6,149,374 A) have the disadvantage that the spars of the front boom, which run on both sides of the driver cabin above the wheels and overlap the particular front wheel with a curved section, block the access to the driver cabin from the side of the loader due to their linkage on the rear, so that entrance into the driver cabin must be performed from the front, which leads to difficulties due to the operating elements for the loader to be positioned on the front side of a driver cabin.

SUMMARY OF THE INVENTION

The present invention is therefore based on the object of designing a loader of the type initially described using simple constructive means so that, in spite of the linkage of a front boom on the rear, unhindered lateral access to the driver cabin may be insured.

The present invention achieves the object stated in that the spars have a lengthwise section, engaging between the front and rear wheels in the lowered setting of the front boom and running below a lateral cabin entrance, to which the curved section overlapping the particular front wheel is attached.

Since, as a consequence of this measure, the lateral spars run in a lengthwise section between the front and rear wheels of the loader in the lowered setting of the front boom, the driver cabin is accessible above the this lowered lengthwise section of the spars in the lowered setting of the front boom, through which the lateral entrance into the driver cabin is possible without obstruction, because the cabin doors closing the entrances on both sides must merely be positioned above the lowered spars for this purpose. However, a requirement for this is that sufficient turning of the spars is made possible through one of the curved sections overlapping the particular front wheel. It is to be taken into consideration in this context that the front and rear wheels project laterally over the support frame.

If the lengthwise section of the lowered spars engaging between the wheels and running essentially horizontally forms a step for entering the driver cabin, the access to the driver cabin is made even easier.

In order to guide the spars in the lowered setting of the front boom above the rear wheels to the lengthwise sections engaging between the wheels, in the lowered setting, the spars may fall from their linkage in a straight line to the lengthwise sections engaging between the wheels, which provides advantageous conditions for the attack of the pivot drive for raising and lowering the front boom, because this pivot drive may be formed by pivot cylinders linked above the rear wheels between the support frame and the spars, which therefore do not obstruct the access to the driver cabin.

BRIEF DESCRIPTION OF THE DRAWING

The object of the present invention is illustrated for exemplary purposes in the drawing, specifically, a loader according to the present invention is shown in a schematic side view.

DESCRIPTION OF THE PREFERRED EMBODIMENT

According to the exemplary embodiment shown, the loader has a support frame 1, which is supported via front and rear wheels 2, 3 and receives a driver cabin 4. A front boom 5, which includes two spars 6 running on both sides of the driver cabin 4, which may be pivoted around a linkage axis 8 via a pivot drive 7 from a lowered setting indicated by solid lines into a raised setting indicated by dot-dash lines, is linked to the frame 1 on the rear side of the driver cabin 4. The spars 6 fall from this linkage axis 8 in a straight line to a lengthwise section 9, running essentially horizontally in the lowered setting of the front boom 5, which engages between the front and rear wheels 2, 3 and continues in a subsequent curved section 10, which overlaps the particular front wheel 2, in order to be able to attach a tool 11 or a corresponding device to the front boom 5 directly in front of the front wheel 2. Since the middle lengthwise section 9 of the spars 6 largely releases the driver cabin 4 through this special implementation of the front boom 5, the driver cabin 4 may be provided with lateral cabin doors 12 above the lowered spars 6, which may be opened over the spars 9 and allow lateral entrance into the driver cabin 4. The central lengthwise section 9 of the spars 10 may advantageously be implemented as a step in order to make entrance into the driver cabin 4 easier.

Due to the comparatively high-mounted linkage axis 8 of the front boom 5, these spars 6 may be guided above the rear wheels 3 to the central lengthwise section 9 without anything further. This spar shape opens the advantageous possibility of providing lateral pivot cylinders 13 as pivot drive 7, which come to rest above the rear wheels 3 and are linked between the spars 6 and the support 1 in the region of counterweights 14.

What is claimed is:

1. A loader comprising (a) a support frame supported on front and rear wheels, (b) a driver cabin arranged on the support frame and having a lateral cabin entrance, (c) a front boom linked to the support frame rearwardly of the driver cabin and above the rear wheels, the front boom comprising (1) two spars extending on respective sides of the driver cabins, and each spar having a lengthwise section and an adjoining curved section, and (d) a pivot drive connected to the spars rearwardly of the driver cabin for moving the front boom between a lowered end raised position, (1) one of the lengthwise spar sections extending between the front and rear wheels below the lateral cabin entrance in the lowered position of the front boom, and the curved spar sections overlapping the front wheels in the lowered front boom position.

2. The loader of claim 1, wherein the one lengthwise spar section extends substantially horizontally and forms a step for the cabin entrance in the lowered from boom position.

3. The loader of claim 1, wherein the each spar has a rectilinear section extending between a pivot axis for the front boom and the lengthwise section, the rectilinear section descending from the pivot axis to the lengthwise section in the lowered front boom position.

* * * * *